US009701154B2

(12) United States Patent
Parker et al.

(10) Patent No.: US 9,701,154 B2
(45) Date of Patent: Jul. 11, 2017

(54) CHALK REEL

(71) Applicant: Irwin Industrial Tool Company, Huntersville, NC (US)

(72) Inventors: Gregory David Parker, Charlotte, NC (US); Norman John LeBlanc, Davidson, NC (US); Robin E. Smith, Stanley, NC (US); Anthony DeLeo, Portage, MI (US); Michael H. Reedy, Portage, MI (US); Brian Butler, Kalamazoo, MI (US); Douglas Johnson, Belmont, NC (US)

(73) Assignee: IRWIN INDUSTRIAL TOOL COMPANY, Huntersville, NC (US)

( * ) Notice: Subject to any disclaimer, the term of this patent is extended or adjusted under 35 U.S.C. 154(b) by 117 days.

(21) Appl. No.: 14/723,856

(22) Filed: May 28, 2015

(65) Prior Publication Data

US 2016/0347117 A1 Dec. 1, 2016

(51) Int. Cl.
*B44D 3/38* (2006.01)

(52) U.S. Cl.
CPC ..... *B44D 3/38* (2013.01)

(58) Field of Classification Search
CPC ..... B44D 3/38
USPC ..... 33/414
See application file for complete search history.

(56) References Cited

U.S. PATENT DOCUMENTS 997,831 A * 7/1911 Kiso ..... B44D 3/38 33/414
1,064,087 A * 6/1913 Prescott ..... B44D 3/38 33/414
1,567,976 A * 12/1925 Myers ..... B44D 3/38 33/414
3,099,091 A * 7/1963 Hindall ..... B44D 3/38 33/414
3,438,595 A * 4/1969 West ..... A63C 19/08 242/284
5,644,852 A * 7/1997 Fuller ..... B44D 3/38 33/393
6,393,709 B1 * 5/2002 Jones ..... B44D 3/38 33/414
7,197,831 B2 * 4/2007 Nepil ..... B44D 3/38 220/375
7,200,949 B2 * 4/2007 Leslie ..... B44D 3/38 33/414
7,624,509 B2 * 12/2009 Hanson ..... B44D 3/38 33/414
7,770,300 B2 * 8/2010 Johnson ..... B44D 3/38 33/414

(Continued)

FOREIGN PATENT DOCUMENTS

SE EP 2420390 A1 * 2/2012 ..... B44D 3/38

*Primary Examiner* — Christopher Fulton
(74) *Attorney, Agent, or Firm* — Eversheds Sutherland (US) LLP

(57) ABSTRACT

A chalk reel has a housing defining a chalk chamber and an opening for accessing the chamber. A door is movable between an open position for allowing access through the opening to the chalk chamber and a closed position preventing access to the chamber. A lock assembly is provided on the door and is movable with the door. The lock assembly rotates relative to the door between a locked position and an unlocked position and reciprocates to secure and release a lock member.

20 Claims, 6 Drawing Sheets

(56) References Cited

U.S. PATENT DOCUMENTS

| | | | | |
|---|---|---|---|---|
| 8,713,810 | B2 * | 5/2014 | Spaulding | B44D 3/38 33/414 |
| 2007/0240320 | A1 * | 10/2007 | Hickey | B44D 3/38 33/414 |

* cited by examiner

CHALK REEL

The invention relates to chalk line marking devices commonly referred to as chalk reels, chalk spools, chalk boxes or chalk lines (hereinafter referred to as "chalk reel").

BACKGROUND

Chalk reels are known that consist of a spool on which a line or string is wound. The spool, line and the drive transmission for the spool are supported in a housing. The drive transmission may comprise gears, springs and other components that connect the spool to an external handle for rewinding the line on the spool after use. A chalk chamber is filled or partially filled with a colored chalk such that as the line that is wound on the spool it is coated in chalk. The line can be unwound from the housing through an aperture in the housing such that it can be "snapped" on a surface to form a line of chalk on the surface. The resulting line of chalk can be used as a reference line in construction or other applications.

SUMMARY OF THE INVENTION

In some embodiments a chalk reel comprises a housing defining a chamber and an opening for accessing the chamber. A door is movable between an open position for allowing access through the opening to the chamber and a closed position preventing access to the chamber. A rotatable lock assembly is provided on the door and is movable with the door, the lock assembly comprises a lock member rotatable relative to the door between a locked position and an unlocked position.

A line may be wound on a reel in the housing and extend from housing through an aperture in the door. The door may pivot relative to the housing between the open position and the closed position. A seal may be formed around the periphery of the opening that is engaged by the door. The lock assembly may comprise a cap that is rotatably mounted in the aperture in the door and the cap may be operatively coupled to the lock member and may include a through hole for receiving the line. The cap may be operatively coupled to the lock member and may be mounted in the aperture for rotational and reciprocating motion relative to the door. A spring may exert a bias force on the cap that biases the cap in a first reciprocating direction. The lock member may move with the cap such that the lock member may be rotated between the locked position and the unlocked position. The lock member may comprise a projection that projects laterally from the cap. A bias force may be exerted on the lock assembly and the lock member may be biased into engagement with an engagement structure when the lock member is in the locked position. The engagement structure may comprise a recess on the housing. A force may be applied to the cap against the bias force to move the lock member out of the recess. An abutment surface may extend into the path of travel of the lock member to prevent the cap from rotating through more than a predetermined angle. One of a detent and a tab may be provided on the door that engages the other one of the detent and the tab on the lock assembly when the lock assembly is in the locked position to prevent rotation of the lock assembly. The lock assembly may rotate and reciprocate relative to the door and a spring may exert a bias force that biases the lock assembly in a first direction to engage the detent with the tab. A force may be applied to the lock assembly in a second direction against the bias force provided by the spring to disengage the tab from the detent.

At least a second one of a detent and a tab may be provided on one of the door and the lock member to prevent rotation of the lock assembly when the lock assembly is in the unlocked position. A through hole may be provided in the cap for receiving the line such that a first end of the line extends into the housing and is wound on a reel and a second end of the line extends from the housing and is connected to an end hook. The cap may comprise a docking member for retaining the end hook using a press fit.

In some embodiments a chalk reel comprises a housing defining a chalk chamber and an opening for accessing the chalk chamber. A door is movable between an open position for allowing access through the opening to the chalk chamber and a closed position preventing access to the chalk chamber. A cap is provided on the door and is movable with the door. The cap is mounted in the door for rotation and reciprocation relative to the door and comprises a locking member engageable with the housing to lock the door in the closed position. A spring biases the lock member in a first reciprocating direction into engagement with the housing.

DETAILED DESCRIPTION OF PREFERRED EMBODIMENTS OF THE INVENTION

Figure 2:
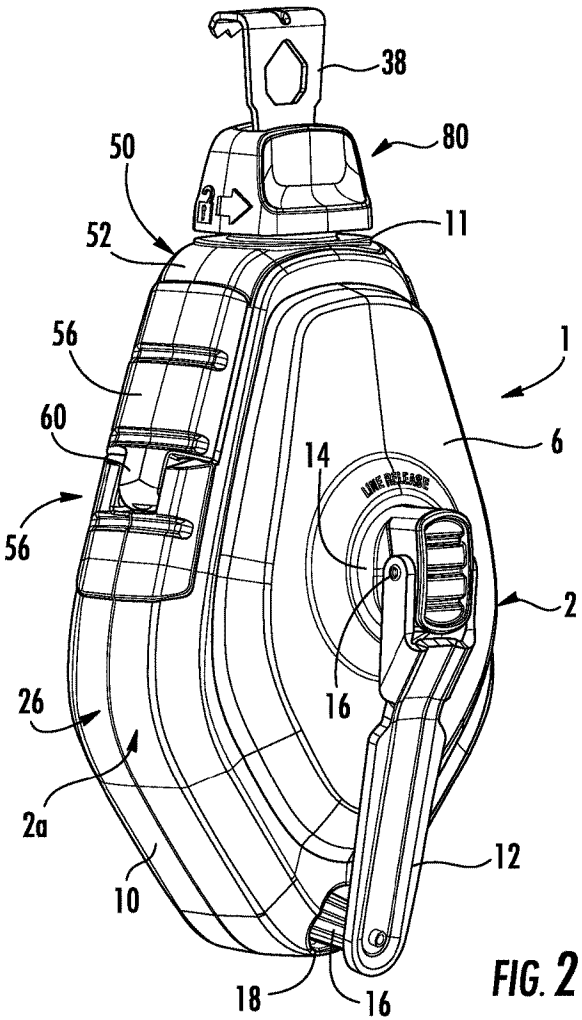
FIG. 2 is a perspective view of the chalk reel of FIG. 1.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

Relative terms such as "below" or "above" or "upper" or "lower" or "horizontal" or "vertical" or "top" or "bottom" may be used herein to describe a relationship of one element, component or region to another element, component or region as illustrated in the figures. It will be understood that these terms are intended to encompass different orientations of the device in addition to the orientation depicted in the figures.

The chalk reel of the invention is shown generally at 1 in the drawings. The chalk reel 1 comprises a housing 2 formed of a front housing section 2*a* and a back housing section 2*b*. The front housing section 2*a* and the back housing section 2*b* may be connected together by fasteners (not shown) such as threaded screws or other releasable connection mechanisms such that the housing sections may be separated. The front housing section 2*a* and back housing section 2*b* may also be secured together by adhesive, welding, a mechanical snap fit connection or the like. When the housing sections 2*a* and 2*b* are secured together, the housing comprises a front wall 6, a back wall 8 and a side wall 10 connecting the front wall and the back wall. The chalk reel 1 may have a variety of shapes and sizes and in the illustrated embodiment has a tear drop shape where the side wall 10 curves around the reel 30 and converges to a rounded point at the bottom of the housing and converges to a relatively flat top side wall portion 11 at the top of the housing.

Figure 6:
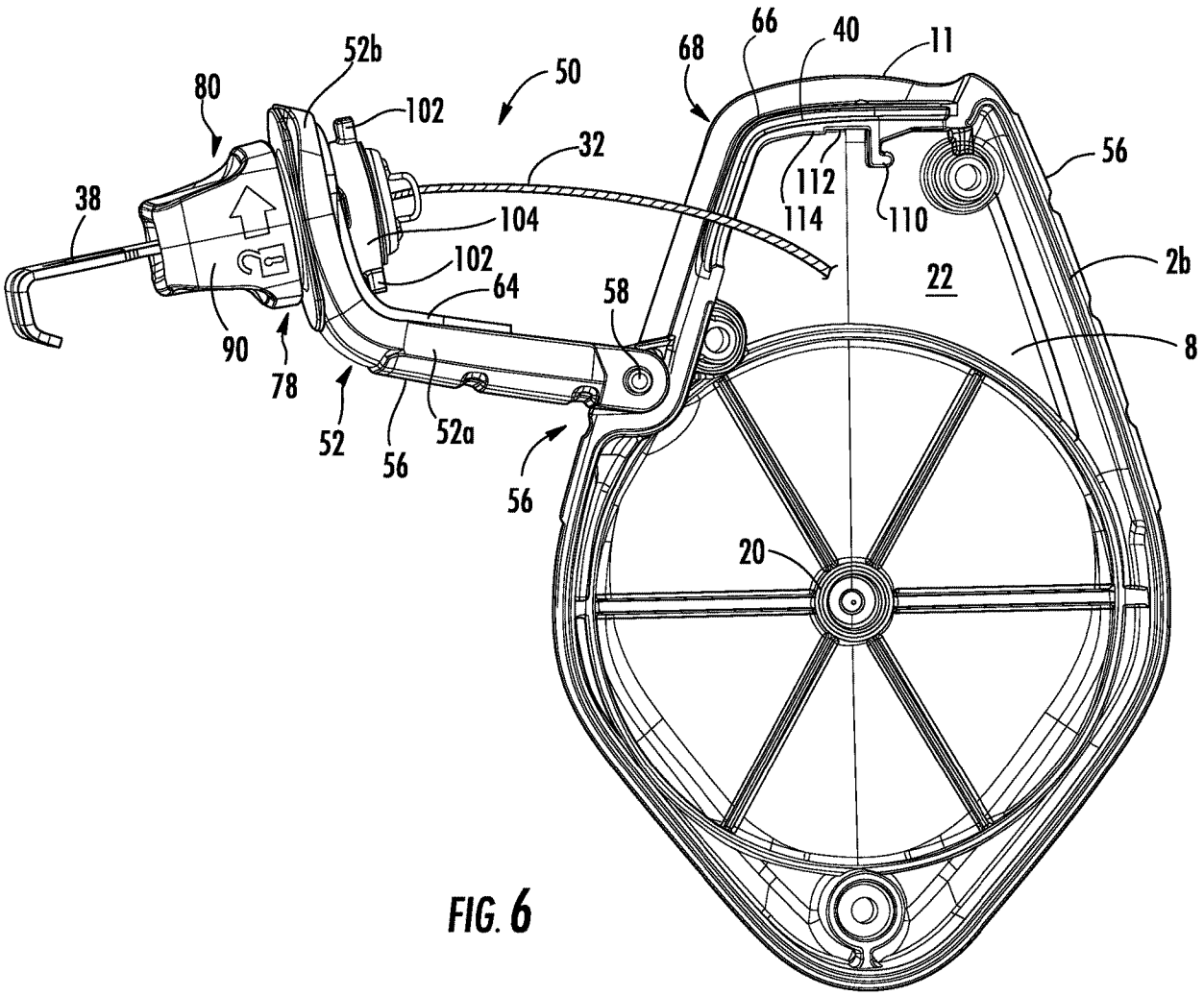
FIG. 6 is a plan view of the back housing section of the chalk reel of FIG. 1.

The spool drive mechanism comprises a rewind handle 12 that is mounted for rotary motion. The handle 12 is connected to rotary member 14 at pivot 16 such that the handle 12 can be pivoted from the locked position shown in the figures to an extended position where handle 12 can be used to rotate member 14 in housing 2. In the locked position a rotary grip 16 may be inserted into a recess 18 formed in the housing 2 to prevent rotation of the handle 12. Rotary member 14 is operatively connected to spool 30. Spool 30 may be mounted for rotational motion in housing 2 on posts 20 that extend from the front housing section 2*a* and the back housing section 2*b* (one of which is shown in FIG. 6). When the handle 12 is rotated in a first direction the spool 30 is rotated in a first direction to rewind the string or line 32 into the housing 2 and onto spool 30. A transmission such as a gear train may operatively connect the rotary member 14 to the spool 30 to provide a mechanical advantage for the user when rotating the handle 12. When the line 32 is pulled from the housing 2 during use, the spool 30 is rotated in the opposite direction to unwind the line 32. The rotary member 14 may be rotated during unwinding of the line or a clutch may be provided such that the handle 12 does not rotate during unwinding of the line 32. Other mechanisms for extending or retracting the line 32 may be used.

Line 32 is wound on the spool 30 and extends from housing 2 through the door assembly 50 as will hereinafter be described. An end hook 38 may be attached to the exposed end of the line 32 to allow the line to be temporarily attached to a structure during use. The line 32 passes through a chalk chamber 22 in housing 2 that is filled with chalk such that the line is impregnated with chalk as it is retracted into and/or extended from housing 2.

Figure 1:
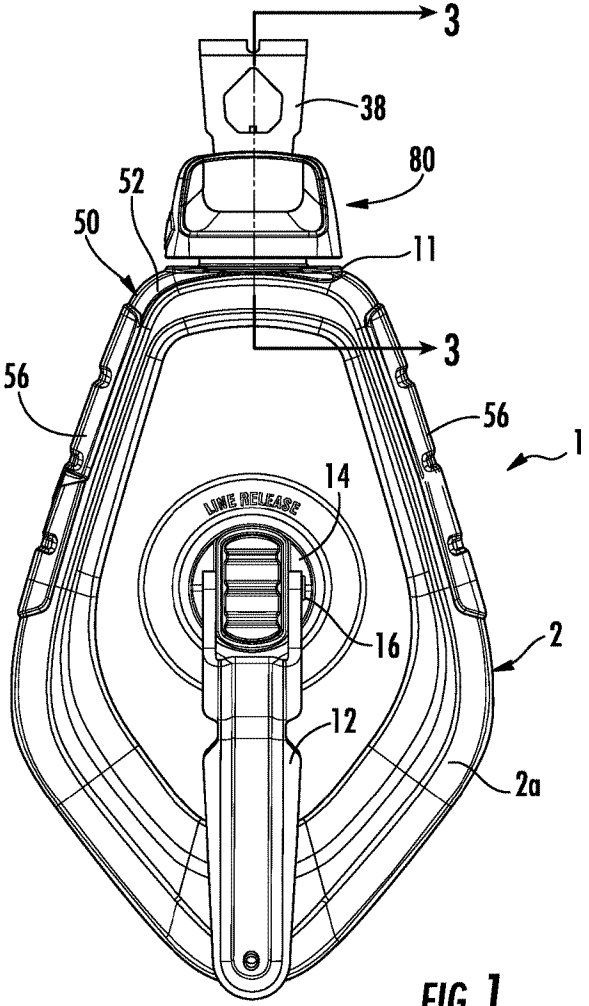
FIG. 1 is a plan view of the chalk reel of the invention.
Figure 5:
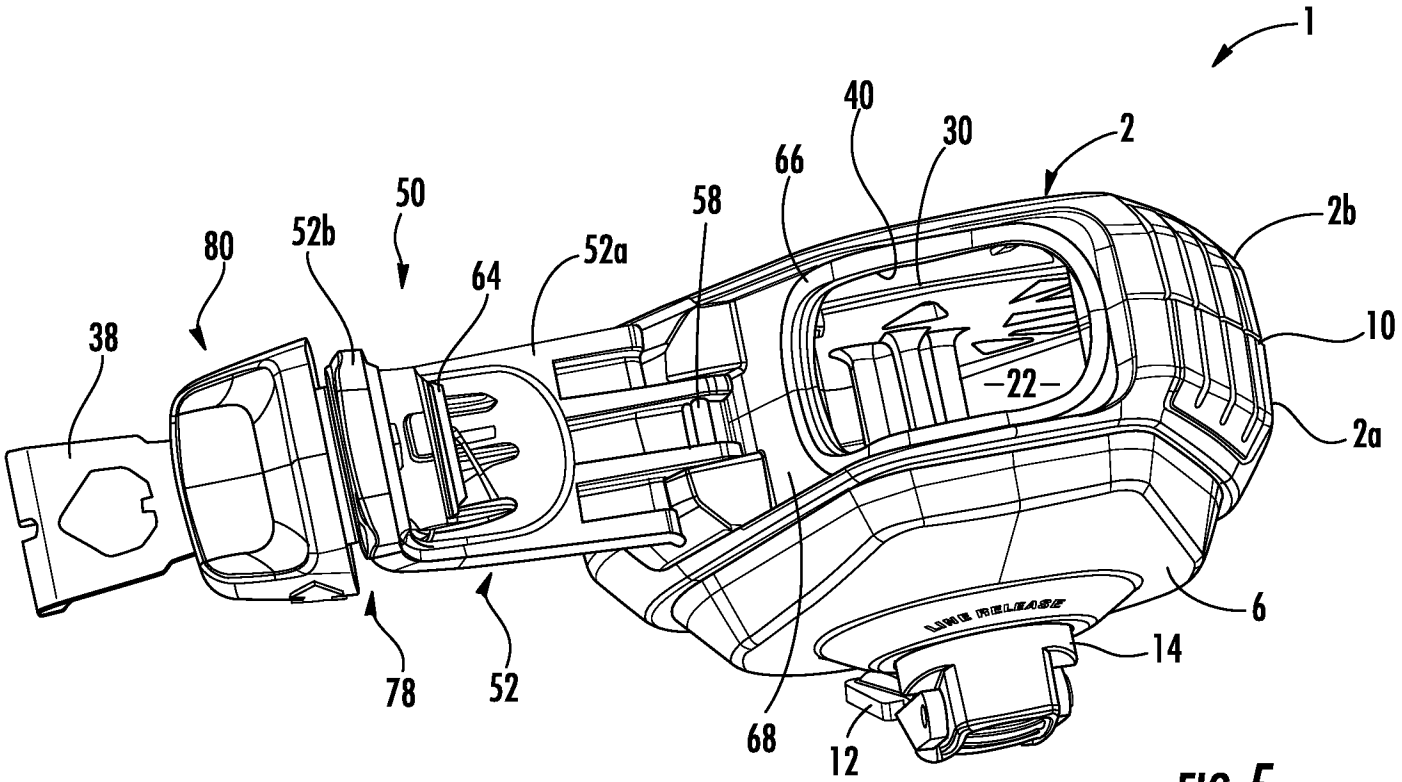
FIG. 5 is a perspective view of the chalk reel of FIG. 1 with the door open.

The chalk chamber 22 is accessed via an opening 40 in housing 2. The front housing 2*a* and back housing 2*b* trap the door assembly 50 therebetween such that the door assembly 50 can pivot relative to the housing 2 between an open position and a closed position. When the door assembly 50 is in the open position (FIG. 5) the internal chamber 22 of the housing may be accessed through opening 40 to allow access to the interior of the housing for refilling chalk, inspection or maintenance, or the like. When the door assembly 50 is in the closed position (FIGS. 1 and 2) the internal chamber 22 is sealed shut to prevent the escape of chalk from housing 2. In one embodiment, the opening 40 is formed in the side wall 10 such that the periphery or edge 42 of the opening 40 is in two intersecting planes. Making the door in two intersecting planes as shown in the illustrated embodiment allows the cap 80 to be positioned at the relatively short top side wall portion 11 of the tear drop shaped housing 2 while providing an opening having a relatively large area. If the opening 40 was provided only along the top side wall portion 11 of the side wall, the size of the opening would be limited to the width of side wall portion 11 thereby limiting access to the interior of the housing. If the opening was provided only along a side of the housing 2, the opening may be made larger but the cap 80 would not be positioned at the top end of the tear drop shaped housing. By making the opening 40 traverse the top side wall portion 11 of the housing and a portion of the side portion of the housing the opening 40 may be made sufficiently large and the cap 80 may be positioned at the narrow top end of the housing.

The opening 40 is selectively closed by door assembly 50. The door assembly 50 comprises a door 52 that is configured to correspond to the shape and the size of opening 40 to form a seal with the opening 40. Because the opening 40 extends in two planes, the door 52 also is configured to extend in two planes such that it has a generally L-shape where one leg 52*a* extends along the side of the housing and the other leg 52*b* extends along the top end of the housing.

The door 52 is pivotably connected to the housing at hinge 56. Hinge 56 comprises a pin 58 that is trapped between the housing portions 2*a*, 2*b* and defines the pivot axis of the door 52. The door comprises a knuckle 60 that is mounted on the pin 58. The knuckle 60 includes a pair of spaced holes 62 that receive the pin 58 such that the door 52 may rotate with pin 58 between open and closed positions as the pin 58 rotates in opposed receiving holes formed in the housing 2. The door 52 includes a flange 64 that extends into the opening 40. A seal 66 such as a low durometer gasket is formed around the periphery of opening 40 that is engaged and deformed by the flange 64 and door 52 to create a tight seal between the door 52 and the housing 2 to prevent chalk from leaking from the housing 2 through opening 40. The seal 66 may be overmolded on the front and back housing sections or overmolded on a separate insert piece that is attached in the opening formed in the housing 2.

In one embodiment the door 52 fits into a recessed area 68 formed in the side wall 10 such that when the door 52 is closed the door does not protrude beyond the periphery of the housing 2. As shown in the figures the side wall 10 in the area of opening 40 is set back from the periphery of the front wall 2*a* and back wall 2*b* of housing 2 such that the front wall 6 and back wall 8 extend beyond the side wall 10 to create the recessed area 68 for receiving the door 52. When the door 52 is closed the door fits into the recessed area 68 such that the door does not protrude beyond the front and back walls of the housing. By this arrangement the side of the housing with door 52 looks the same as the opposite side of the housing. In some embodiments, soft, elastomer grip surfaces 56 may be attached to the housing 2 and/or door 52 such as by an insert molding or overmolding process. The grip surfaces 56 may also be attached by separate fasteners, adhesive or the like.

To secure the door 52 in the closed position the door assembly 50 includes a lock assembly 78. The lock assembly 78 comprises a cap 80 that is rotatably mounted in an aperture 82 formed in door 52. The cap 80 comprises a generally cylindrical body portion 84 that is inserted into the aperture 82. The body portion 84 is free to rotate in the aperture 82 between a locked and an unlocked position and is free to linearly translate or reciprocate along the axis of aperture 82. In one embodiment the cap 80 is limited to approximately 180 degrees of rotation between the locked and unlocked position as will hereinafter be described. A seal 86 may be provided between the cap 80 and the periphery of aperture 82 to prevent chalk form leaking from the housing through aperture 82. In one embodiment the seal comprises an O-ring that is located in an annular groove 88 formed in the body portion 84.

Figure 4:
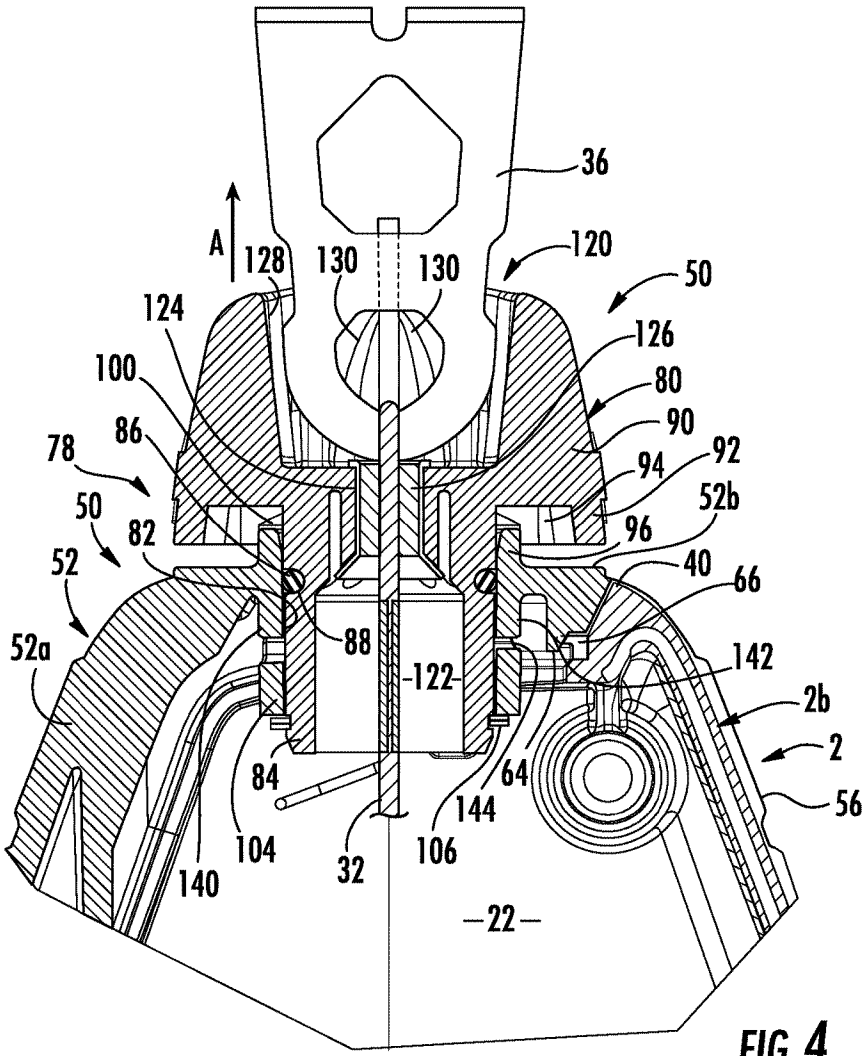
FIG. 4 is a section view orthogonal to FIG. 3.

The cap 80 also comprises a top portion 90 that extends from the body portion 84 and is accessible to the user. The user may rotate the cap 80 by rotating the top portion 90. In one embodiment the top portion 90 of the cap 80 and the body portion 84 of the cap 80 are made of a unitary, single piece. A downwardly extending annular flange 92 extends from the top portion to define a downwardly facing annular cavity 94 that receives an upwardly extending flange 96 that extends from the periphery of aperture 82. A wave spring 100 is located in the cavity 94 that is trapped between the top edge of the flange 96 and the inside of the cavity 94 such that the wave spring exerts a force on the cap 80 that tends to pull the cap upward as viewed in FIGS. 3 and 4 in the direction of arrow A.

The body portion 84 of the cap 80 supports a pair of lock members 102 that rotate with the cap 80 such that the lock members 102 may be rotated between a locked position and an unlocked position. In the illustrated embodiment the lock members 102 are formed as feet or projections that project laterally from the cap 80. The lock members 102 extend from a ring 104 where the ring 104 is mounted over the body portion 84 such that the lock members 102 extend laterally from the body portion. The lock members 102 are constrained for both rotary and translational motion with the cap 80. In the illustrated embodiment the lock members 102 are connected to the cap using lock washers 106. The lock members 102 may be connected to the cap 80 using any suitable connection mechanisms and in some embodiments the lock members 102 and cap 80 may be formed integrally as a one piece member.

Figure 3:
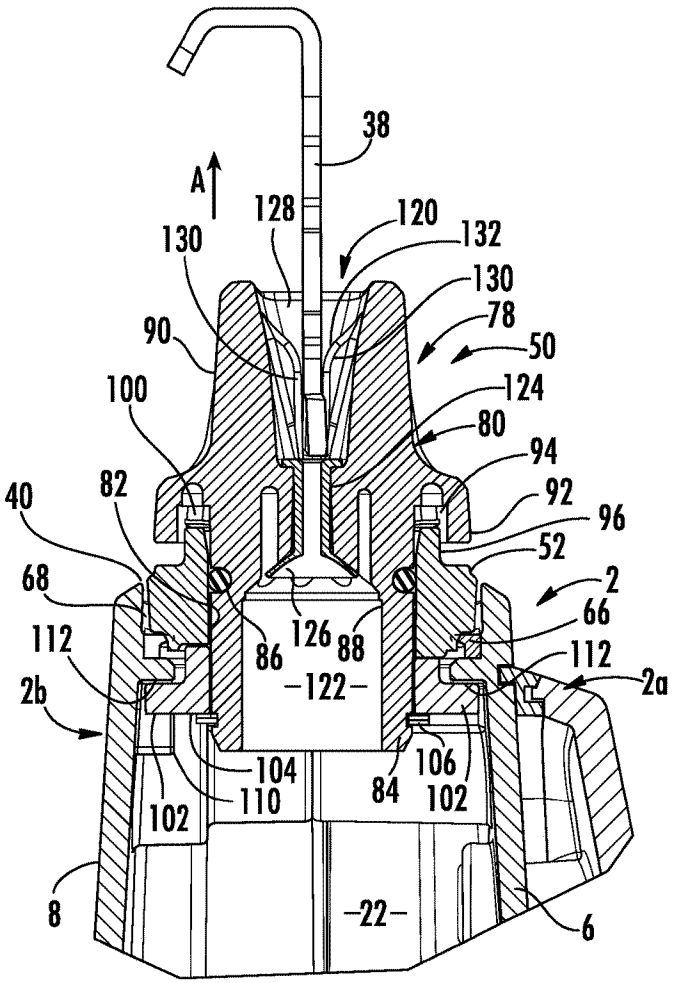
FIG. 3 is a section view taken along line 3-3 of FIG. 1.

FIGS. 3 and 6 show the engagement structures on the housing 2 that are engaged by one of the lock members 102 during locking and unlocking of the door 50. While one housing section 2*b* is shown in FIG. 6 the second housing section 2*a* includes a similar structure for engaging the second lock member. The engagement structures are provided on the interior of the housing 2 and are positioned adjacent the opening 40. The engagement structures are formed as a ledge that may extend from the housing walls. In some embodiments the engagement structures may be formed integrally with the housing sections 2*a*, 2*b* such as by molding the housing sections and engagement structures from plastic. The first engagement structure is an abutment surface 110 that extends into the path of travel of the lock members 102 as the lock members are rotated between the locked and unlocked positions. The abutment surface 110 is positioned such that one of the lock members 102 contacts the abutment surface 110 when the cap 80 is rotated approximately 180 degrees from the locked position toward the unlocked position. The abutment surface 110 prevents a user from over rotating the cap 80 from the locked position when the door is closed. In the illustrated embodiment the abutment surface 110 is shown as an L-shaped member that extends from the top side wall portion 11 and the wall 8; however, the abutment surface 110 may have any suitable configuration provided it engages the lock member 102 to stop over-rotation of the cap 80.

Figure 7:
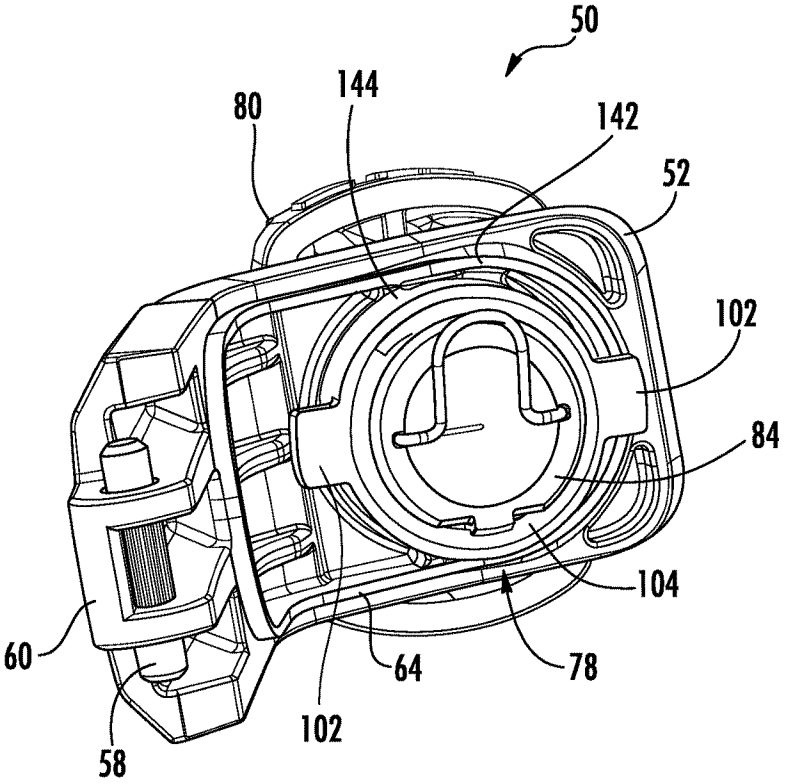
Figure 9:
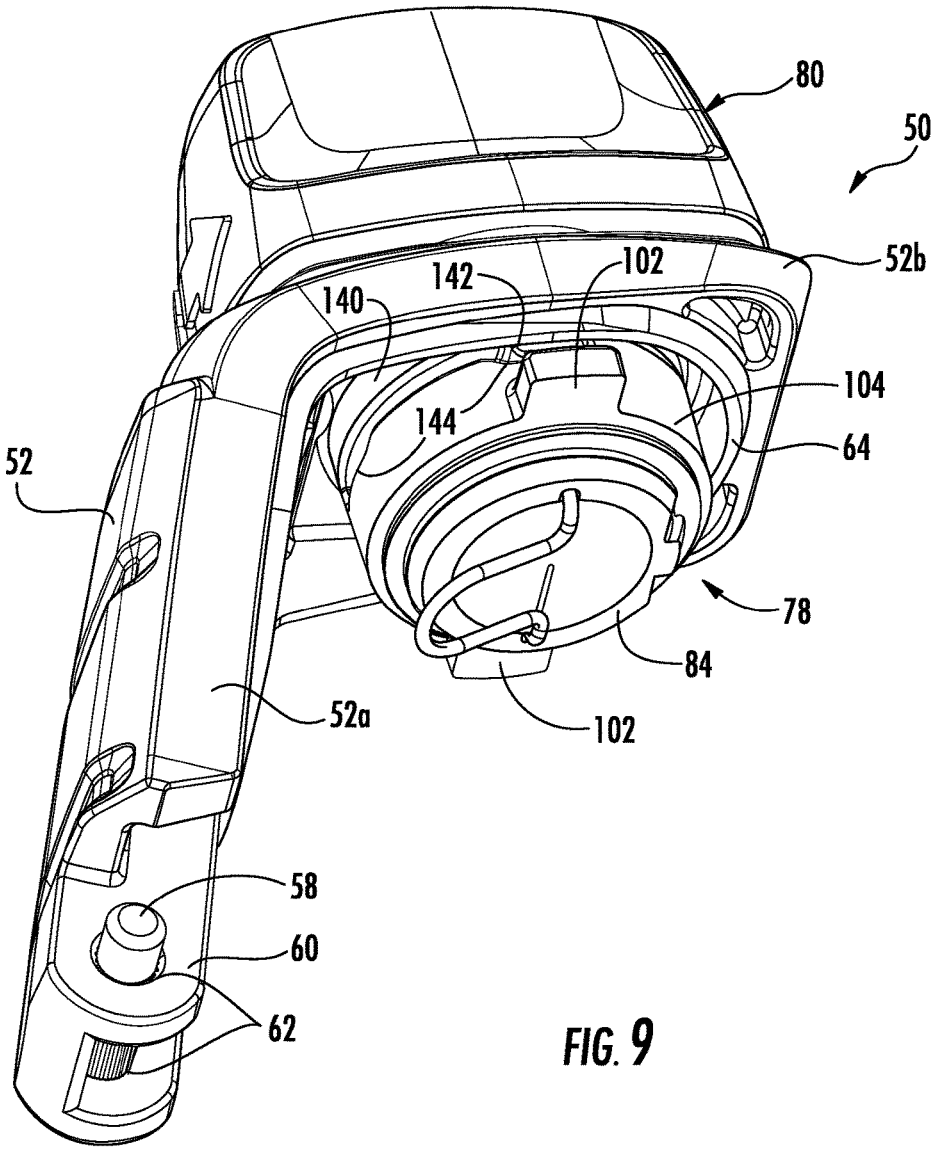

The second engagement structure is a locking recess 112 that is engaged by the lock member 102 when the cap 80 is rotated to the locked position. The recess 112 is formed on the interior of the top side wall portion and is formed between a slightly ramped lead-in surface 114 and the abutment surface 110. The recess 112 is positioned such that it is disposed above the lock member 102 when the lock member is in the locked position. When the cap 80 is rotated to the locked position, the lock member 102, as it approaches the fully locked position, slides over the slight ramped lead-in surface 114 such that the lock member 102 and cap 80 are forced slightly downward against the bias force of wave spring 100. When the lock member 102 is aligned with the recess 112, the bias force of the wave spring 100 moves the cap 80 and lock members 102 upward to seat the lock members 102 in the recesses 112. The engagement of the lock members 102 with the recesses 112 holds the cap 80 in the locked position and prevents the cap from rotating away from the locked position and the door from opening. As a result, the door cannot be inadvertently opened during use of the chalk reel. To open the door, the user pushes down on the cap 80 moving cap 80 against the bias force provided by spring 100 to move the lock members 102 out of recesses 112. With the cap 80 held in the depressed position, the user can rotate the cap 80 and lock members 102 to the unlocked position such that the door 50 may be opened. The locking assembly 78 is intended to be rotated approximately 90 degrees between the locked position (FIG. 9) and the unlocked position (FIG. 7). If a user turns the locking assembly 78 more than 90 degrees past the unlocked position the lock members 102 strike the abutment surfaces 110 and rotation of the lock assembly 78 is stopped after a predetermined angle of travel such as approximately 180 degrees.

Figure 8:
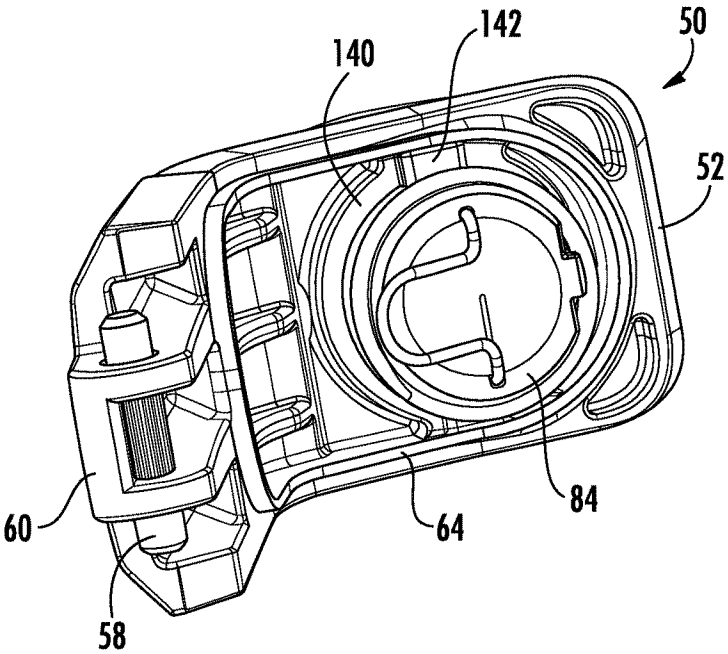
FIGS. 7, 8 and 9 are perspective views of the door assembly of the chalk line of FIG. 1.

To provide fixed positions for the lock assembly 78 in the locked and unlocked positions, a tab and detent arrangement is provided. The tab and detent arrangement comprises a downwardly extending flange 140 that extends from the periphery of aperture 82 toward the interior of the housing 2. At least one projection or tab 142 extends from the flange toward ring 104. FIG. 8 shows the cap assembly 50 without the ring 104 and lock members 102 to show tab 142. Ring 104 includes detents or pockets 144 that face the flange 140. The detents 144 are spaced from one another 90 degrees. When the first detent 144 is aligned with the tab 142 (FIGS. 3, 4 and 9) the cap is in the locked position with the lock members 102 disposed in recesses 112. When the second detent is aligned with tab 142 the lock members 102 are rotated 90 degrees to the unlocked position (FIG. 7) such that the door may be opened. Because spring 100 exerts a force that pulls lock assembly 78 upwardly in the direction of Arrow A, the tabs 142 are forced into the detents 144 in both the locked and the unlocked positions. The engagement of the tabs 142 with the detents 144 prevents the lock assembly 78 from rotating inadvertently during operation of the chalk reel. To rotate the lock assembly 78 the cap 80 is depressed (pressed in the direction opposite to Arrow A) to disengage the tabs 142 from the detents 144 allowing the cap to be rotated. When the lock assembly 78 reaches either the locked or the unlocked position and the cap 80 is released, the spring 100 moves the lock assembly to re-engage the tabs 142 with the detents 144. In order to secure the fixed positions of the lock assembly 78, one tab 144 may be used with two detents 142, two detents may be used with one tab, or multiple tabs and detents may be used provided that at least one tab is able to engage at least one detent in each of the locked and the unlocked positions. While it may be desirable for the convenience of the user to provide a positive engagement at both the locked and unlocked positions of the lock assembly 78 in some embodiments providing a positive engagement only in the locked position may be suitable because it is not as critical to maintain the lock assembly 78 in the unlocked position during maintenance, refilling or inspection of the device when the door is open. Moreover, because the spring 100 provides an upward force on the lock ring 104, the lock ring 104 is forced against the tab 142 even in the absence of a detent and the frictional engagement between the ring 104 and the tab 142 will provide some resistance to turning of the cap. In some embodiments the tabs may be provided on the ring 104 and the detents may be provided on the flange 140.

A through hole 120 extends through the cap 80 for receiving the line 32 that is wound on reel 30 such that the line may be extended from and retracted into the housing 2. The through hole 120 comprises a relatively wide diameter chamber 122 that communicates with the interior of the housing 2. The chamber 122 narrows to a relatively narrow throat 124. A steel grommet or eyelet may be provided in the throat 124 to protect the line 32 from wearing against the hole 120 by reducing friction on the line. The grommet may be inserted into hole 124 and swaged to hold it in place. The through hole 120 expands to a flared chamber 128 that communicates with the exterior of the housing 2. The line 32 is threaded through the through hole 120 and has its internal end wound on reel 30 and its external end connected to end hook 38.

The door 50 pivots in a wide arc to reveal both the opening 40 and the bottom of the door assembly 50. In some embodiments the door rotates through an angle of at least approximately 75 degrees between the closed position and the open position and may rotate over 90 degrees and in some embodiment may rotate between 75 and 120 degrees. The wide arc of travel exposes the bottom of the door assembly 50 to facilitate the user's threading of the line 32 through the through hole 120 without disassembling the chalk reel such as after a line break.

End hook docking members 130 may be formed in the chamber 128 to hold the end hook 32 in place during non-use of the chalk line. The docking members 130 comprise opposed members that define a slot 132 therebetween that is dimensioned to create a force fit with the end hook 32. The pressure on the end hook 32 from the opposed members 130 may be overcome by a user pulling on the end hook to remove the end hook 32 from the cap 80. The members 130 may be molded integrally with and of the same plastic material as the housing 2 and may be formed as relatively thin fins that extend from the wall of the chamber 128 such that the members may deflect or deform slightly to receive the end hook 32. The members may also comprise separate resilient members secured to the housing 2.

While embodiments of the invention are disclosed herein, various changes and modifications can be made without departing from the spirit and scope of the invention as set forth in the claims. One of ordinary skill in the art will recognize that the invention has other applications in other environments. Many embodiments are possible.

The invention claimed is:

1. A chalk reel comprising:

a housing defining a chamber and an opening for accessing the chamber;

a door movable between an open position for allowing access through the opening to the chamber and a closed position preventing access to the chamber, the door defining an aperture therein;

a reel positioned within the housing;

a line wound on the reel and extending from the housing through the aperture; and a rotatable lock assembly provided on the door and movable with the door, the lock assembly comprising:

a cap rotatably mounted in the aperture; and a lock member rotatable relative to the door between a locked position and an unlocked position.

2. The chalk reel of claim 1, wherein the door pivots relative to the housing between the open position and the closed position.

3. The chalk reel of claim 1, further comprising a seal formed around a periphery of the opening configured to be engaged by the door.

4. The chalk reel of claim 1, wherein the cap is operatively coupled to the lock member and defines a through hole for receiving the line.

5. The chalk reel of claim 1, wherein the cap is operatively coupled to the lock member and mounted in the aperture for rotational and reciprocating motion relative to the door.

6. The chalk reel of claim 5, further comprising a spring configured to exert a bias force on the cap that biases the cap in a first reciprocating direction.

7. The chalk reel of claim 5, further comprising an abutment surface that extends into a path of travel of the lock member to prevent the cap from rotating through more than a predetermined angle.

8. The chalk reel of claim 1, wherein the lock member moves with the cap such that the lock member is rotated between the locked position and the unlocked position.

9. The chalk reel of claim 1, wherein the lock member comprises a projection that projects laterally from the cap.

10. The chalk reel of claim 1, further comprising a biasing member configured to exert a bias force on the lock assembly such that the lock member is biased into engagement with an engagement structure when the lock member is in the locked position.

11. The chalk reel of claim 10, wherein the engagement structure comprises a recess defined in the housing.

12. The chalk reel of claim 11, wherein the biasing member is configured such that a force may be applied to the cap against the bias force to move the lock member out of the recess.

13. The chalk reel of claim 1, further comprising:

a detent provided on one of the door and the lock assembly; and a tab provided on the other of the door and the lock assembly;

wherein the tab engages the detent when the lock member is in the locked position to prevent rotation of the lock assembly.

14. The chalk reel of claim 13, wherein the lock assembly rotates and reciprocates relative to the door, and wherein the chalk reel further comprises a spring configured to exert a bias force that biases the lock assembly in a first direction to engage the detent with the tab.

15. The chalk reel of claim 14, wherein the spring is configured such that a force may be applied to the lock assembly in a second direction against the bias force to disengage the tab from the detent.

16. The chalk reel of claim 13, further comprising:

a second detent provided on the one of the door and the lock assembly; and a second tab provided on the other of the door and the lock assembly;

wherein the second tab engages the second detent when the lock member is in the unlocked position to prevent rotation of the lock assembly.

17. The chalk reel of claim 1, wherein the cap defines a through hole for receiving the line, wherein a first portion of the line is positioned within the housing and wound on the reel, and wherein a second portion of the line extends from the housing and is connected to an end hook.

18. The chalk reel of claim 17, wherein the cap comprises a docking member configured to retain the end hook using a press fit.

19. A chalk reel comprising:

a housing defining a chalk chamber and an opening for accessing the chalk chamber;

a door movable between an open position for allowing access through the opening to the chalk chamber and a closed position preventing access to the chalk chamber;

a cap provided on the door and movable with the door, the cap being mounted in the door for rotation and reciprocation relative to the door, the cap comprising lock member engageable with the housing to lock the door in the closed position; and a spring biasing the lock member in a first reciprocating direction into engagement with the housing.

20. A chalk reel comprising:

a housing defining a chamber and an opening for accessing the chamber;

a door movable between an open position for allowing access through the opening to the chamber and a closed position preventing access to the chamber;

a rotatable lock assembly provided on the door and movable with the door, the lock assembly comprising a lock member rotatable relative to the door between a locked position and an unlocked position;

a detent provided on one of the door and the lock assembly; and a tab provided on the other of the door and the lock assembly;

wherein the tab engages the detent when the lock member is in the locked position to prevent rotation of the lock assembly.

* * * * *